United States Patent [19]

Kubozuka et al.

[11] 4,369,744

[45] Jan. 25, 1983

[54] LOW-NOISE LEVEL RECIPROCATING PISTON INTERNAL COMBUSTION ENGINE

[75] Inventors: Takao Kubozuka; Hirofumi Takei, both of Yokosuka, Japan

[73] Assignee: Nissan Motor Company, Limited, Yokohama, Japan

[21] Appl. No.: 173,837

[22] Filed: Jul. 30, 1980

[30] Foreign Application Priority Data

Aug. 2, 1979 [JP] Japan ..... 54-98873

[51] Int. Cl.[3] ..... F02B 77/00

[52] U.S. Cl. ..... 123/198 E; 123/195 C; 123/196 R

[58] Field of Search ..... 123/198 E, 195 C, 195 S, 123/195 H, 196 R, 196 CP

[56] References Cited

U.S. PATENT DOCUMENTS

| | | | |
|---|---|---|---|
| 1,720,625 | 7/1929 | Chorlton | 123/195 H |
| 2,019,657 | 11/1935 | Church | 123/195 H |
| 3,464,398 | 9/1969 | Scheiterlein et al. | 123/198 E |
| 3,991,735 | 11/1976 | Horstmann . | |
| 4,213,440 | 7/1980 | Abe et al. | 123/195 C |

FOREIGN PATENT DOCUMENTS

| | | |
|---|---|---|
| 2043280 | 4/1971 | Fed. Rep. of Germany . |
| 2839885 | 4/1979 | Fed. Rep. of Germany . |
| 2849613 | 5/1979 | Fed. Rep. of Germany . |

*Primary Examiner*—Ira S. Lazarus

*Attorney, Agent, or Firm*—Schwartz, Jeffery, Schwaab, Mack, Blumenthal & Koch

[57] ABSTRACT

Disclosed is a reciprocating piston internal combustion engine comprises a housing device connected to a cylinder block for receiving therein a crankshaft of the engine. The housing device is formed with open chambers spaced from each other by partition walls which support the journals of the crankshaft via main bearings mounted to the partition walls. A sound-insulating panel is attached to the housing device in a manner to sealingly close the open ends of all of the open chambers thereby to permit the chambers to serve as lubricant oil reservers.

13 Claims, 9 Drawing Figures

LOW-NOISE LEVEL RECIPROCATING PISTON INTERNAL COMBUSTION ENGINE

FIELD OF THE INVENTION

The present invention relates to a low-noise level internal combustion engine, more particularly to a reciprocating piston internal combustion engine having means for suppressing engine noise to a considerably low level.

SUMMARY OF THE INVENTION

According to the present invention, there is provided a low-noise level reciprocating piston internal combustion engine. The engine comprises a cylinder block having therein engine cylinders, a housing connected to the cylinder block for receiving therein a crankshaft of the engine, the housing having therein open chambers spaced from each other by partition walls which support the journals of the crankshaft via main bearings mounted to the partition walls, and a sound-insulating panel attached to the housing to sealingly close the open ends of the chambers thereby to permit the chambers to serve as lubricant oil reservoirs.

It is an object of the present invention to provide a reciprocating piston internal combustion engine which is constructed to suppress the engine noise to a considerably low level.

Other objects and advantages of the present invention will become clear from the following description when taken in conjunction with the accompanying drawings.

DESCRIPTION OF THE PRIOR ART

Prior to describing in detail the engine of the present invention, a brief explanation of a conventional internal combustion engine constructed to suppress the engine noise will be made with reference to FIGS. 1 and 2 in order to clarify the invention.

Figure 1:
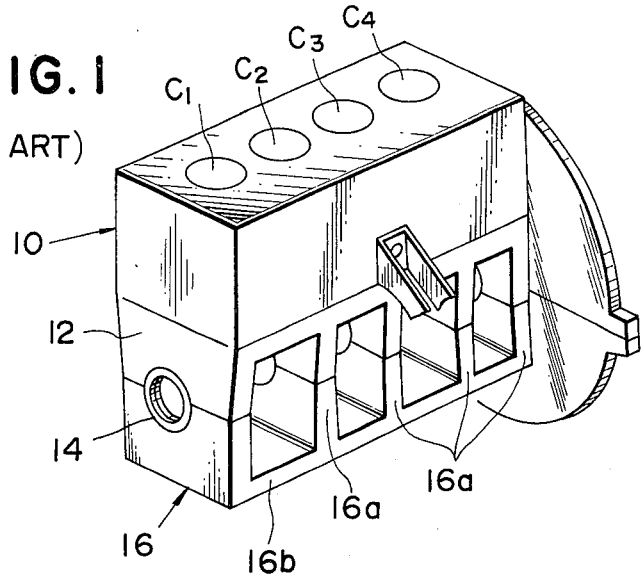
FIG. 1 (PRIOR ART)
FIG. 1 is a perspective view of a cylinder block of a conventional internal combustion engine which is constructed to suppress the engine noise.
Figure 2:
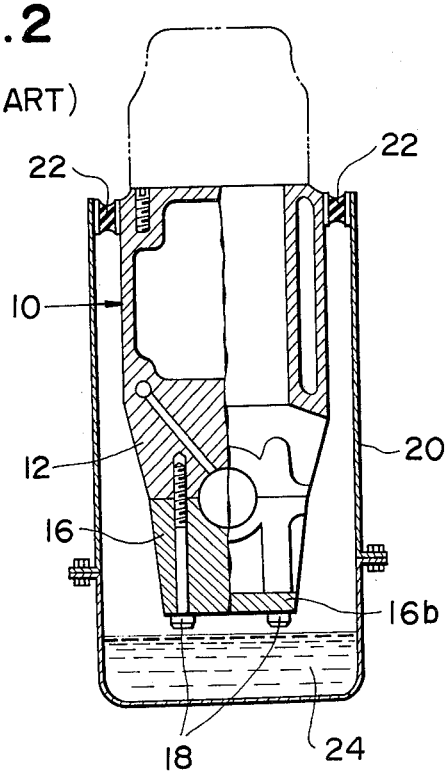
FIG. 2 (PRIOR ART)
FIG. 2 is a cross section view of the engine in which the cylinder block of FIG. 1 is mounted.

Referring to FIGS. 1 and 2, there is shown a conventional low-noise level internal combustion engine. This type engine is disclosed and claimed in U.S. Pat. No. 4,213,440 to Abe et al assigned to Nissan Motor Company, Limited. The engine shown comprises generally a cylinder block 10 which has aligned cylinders (four cylinders $C_1$, $C_2$, $C_3$ and $C_4$). The cylinder block 10 is integrally formed at its lower section with a bearing support portion 12. The bearing support portion 12 has five downwardly extending walls (no numerals) which are spaced from each other. Each wall is formed with a round recess in which an upper half of a main bearing 14 is tightly disposed, although only one bearing is illustrated in FIG. 1. A bearing support block 16 having five upwardly extending spaced walls **16*a* is coupled by means of bolts 18 (see FIG. 2) with the bearing support portion 12 in such a manner that the upper edges of the walls 16*a* of the block 16 are respectively connected to the lower edges of the walls of the portion 12, as shown. Each wall 16*a* of the block 16 is formed at a portion corresponding to the round recess of the corresponding wall of the bearing support portion 12 with a round recess in which a lower half of the main bearing is tightly disposed to constitute the entire construction of the main bearing in cooperation with the upper half of the main bearing. Although not shown in the drawings, a crankshaft is operatively supported at their journals by the main bearings 14**.

As shown in FIG. 2, a sound-insulating cover 20 composed of upper and lower parts is arranged to cover the major portion of the engine proper with the lower part serving as an oil pan. Elastomeric supporting members 22 are arranged to support the cover 20 on the engine proper. With regard to the engine hereinabove described, it has been known that the construction of the bearing support block 16 in which the walls **16*a* thereof are each connected integrally to the bottom wall 16*b* thereof to increase the flexural rigidity of the walls 16*a* thereby suppressing, under operation of the engine, vibration of the walls to a sufficiently low level. The vibration suppression of the walls 16*a* of the bearing support block 16 reduces the degree of induced vibration of the cover 20** thereby reducing the noise produced by the walls.

In the conventional engine described hereinabove, however, the following drawbacks are encountered, originating from the nature of the elastomeric supporting members 22. In practical use, the elastomeric supporting members 22 are each constructed of a material having a considerably high spring constant by taking into consideration the fact that not only the weight of the cover 20 of itself but also the weight of the lubricant oil 24 puddled in the bottom of the cover 20 are placed on the supporting members 22. This causes a drawback in engine-noise reduction in view of a fact that the sound-insulating effect of the cover 20 is considerably reduced with an increase in spring constant of the supporting member 22. In fact, the above-mentioned noise reduction construction fails to effectively insulate the medium and low frequency vibrations of the cylinder block 10 and/or the walls **16*a* of the bearing supporting block 16. Furthermore, new medium and low frequency noise is produced by the cover 20 when the frequency of the vibration of the cylinder block 10 and/or the walls 16*a* of the bearing support block 16 coincides with the natural resonance frequency of the cover 20**.

Thus, an essential object of the present invention is to solve the drawback encountered in the above-mentioned type internal combustion engine.

DESCRIPTION OF THE PREFERRED EMBODIMENTS

Figure 3:
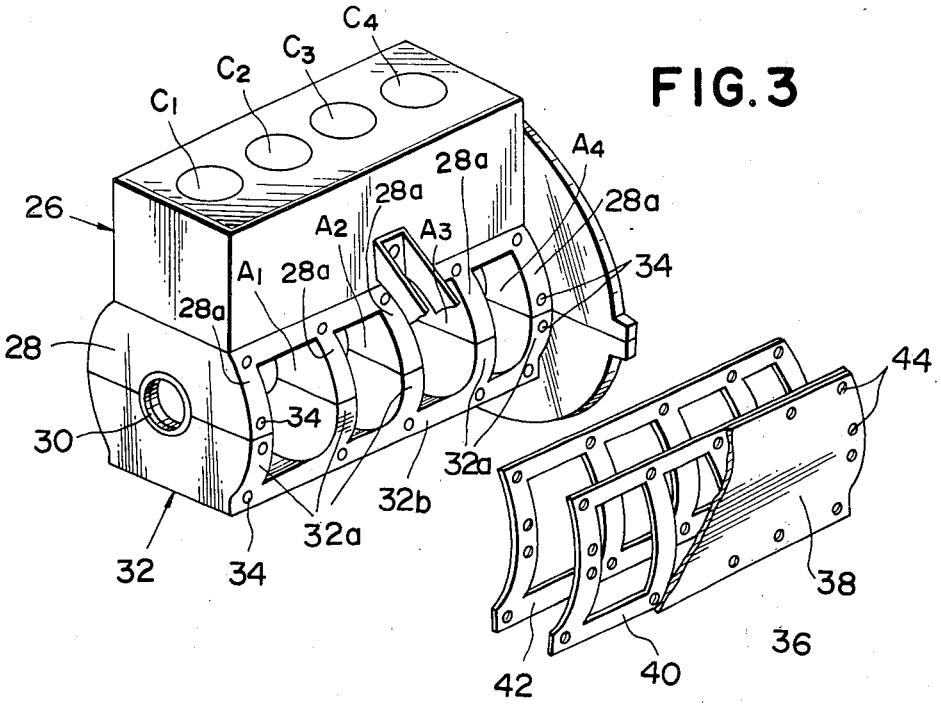
FIG. 3 is a perspective partly broken view of an internal combuston engine of the first embodiment according to the present invention.
Figure 4:
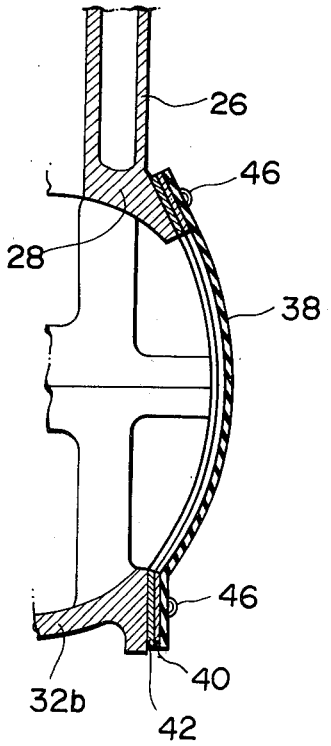
FIG. 4 is an enlarged section view of a part of the engine of FIG. 3.

Referring to FIGS. 3 and 4 of the drawings, there is shown a first embodiment of the present invention. The internal combustion engine of this first embodiment comprises a cylinder block 26 which has, for example, four aligned cylinders $C_1$ to $C_4$. Similar to the aforementioned conventional engine, the cylinder block 26 is integrally formed at its lower section with a bearing support portion 28. The bearing support portion 28 has five downwardly extending walls 28*a* which are spaced from each other. Each wall 28*a* is formed with a round recess in which an upper half of a main bearing 30 is tightly disposed, although only one bearing is illustrated in FIG. 3. A bearing support block 32 having five upwardly extending spaced walls 32*a* is coupled by means of bolts (not shown) with the bearing support portion 12 in such a manner that the upper edges of the walls 32*a* of the block 32 are respectively attached to the lower edges of the walls 28*a* of the bearing support portion 28, as shown. Each wall 32*a* of the block is formed at a portion corresponding to the recess of the corresponding wall of the bearing support portion 28 with a round recess in which a lower half of the main bearing 30 is tightly disposed so as to make up the entire construction of the main bearing 30. The walls 32*a* are each integrally connected to the bottom wall 32*b* of the block 32, and the walls 32*a*, except for the two exterior walls, are formed at their lower sections with openings (not shown) by which all of chambers $A_1$ to $A_4$ thus formed in the crankshaft housing communicate with one another. As is best shown in FIG. 3, both sides of each wall 28*a* of the bearing support portion 28 and corresponding sides of each wall 32*a* of the bearing support block 32 are convexly curved so that upon assembly of the portion 28 with the block 32, the attached two walls 28*a* and 32*a* have smoothly curved surfaces on both their sides, as shown. The bearing support portion 28 and the bearing support block 32 have at their sides a number of bolt holes 34. For facilitation of the following description, the unit consisting of the portion 28 and the block 32 will be designated as "crankshaft housing" hereinafter.

Two sets of sound-insulating panels 36 (although only one is shown) are mounted respectively on both sides of the crankshaft housing in a manner to sealingly close the open ends of the chambers $A_1$ to $A_4$ formed in the housing. Each panel 36 comprises a sound-absorbing sheet 38 made of a high damping material, a frame 40 to which the sheet 38 is secured by baking, and a gasket 42. As shown in FIG. 3, each panel 36 has a number of bolt holes at positions corresponding to the holes 34 of the crankshaft housing. Connection of the panels 36 to the crankshaft housing is made by bolts 46 (see FIG. 4) which are screwed into the holes 34 of the housing through the holes 44 of the panels 36. Thus, it will be appreciated that each of the chambers $A_1$ to $A_4$ of the crankshaft housing forms an isolated sealed chamber in which the lubricant oil can be reserved. Further, if desired, a sound-insulating cover such as the upper part of the cover 20 of FIG. 1 may be provided for the engine in substantially the same manner as in the case of FIG. 1. In this case, the supporting members for connecting such cover to the engine can be constructed of a material having a relatively low spring constant because of low weight construction of the cover having no oil pan section.

With the construction of the first embodiment described hereinabove, the vibration of the cylinder block 26 and that of the bearing support block 32 are considerably absorved by the sound-absorbing sheets 38 mounted thereon, so that noises which may be caused by such vibrations are minimized. In fact, it has been revealed that the vibration of the sound-absorbing sheets 38 is negligible, and the medium and low frequency vibration noises are effectively reduced. It should be noted that the high frequency vibration noise is effectively reduced by the specially designed bearing supporting block 32 in which the walls 32*a* are each integrated with the bottom wall 32*b*.

Figure 5:
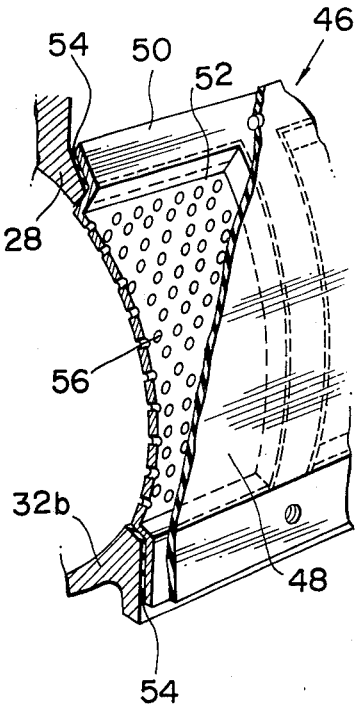
FIG. 5 is a perspective partly broken view of the essential part of an internal combustion engine of the second embodiment according to the present invention.
Figure 6:
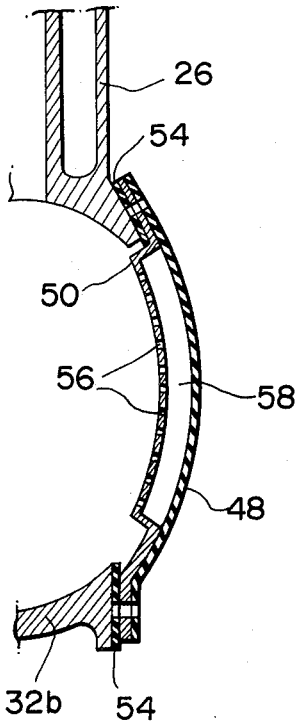
FIG. 6 is a section view of a part of the engine of FIG. 5.

Referring to FIGS. 5 and 6, there is shown the second embodiment of the engine according to the present invention. In this second embodiment, there are advantages with respect to the first embodiment in that not only the engine weight but also the production cost of the engine can be reduced. Each of the sound-insulating panels 46 of this second embodiment comprises a thin film member 48 of a high damping material which is considerably thinner than the sound-absorbing sheet 38 of the first embodiment, an attaching metal plate 50 which has rectangular depressions 52 spaced from each other, and a gasket 54. The depressions 52 of the attaching plate 50 are formed at the bottom walls thereof with a plurality of through holes 56, further the depressions 52 are shaped to respectively match the forms of the smoothly curved open ends of chambers $A_1$ to $A_4$ in the crankshaft housing, so that the projected backwall defined by each depression 52 is received in the open end of the corresponding chamber. Connection of the sound-insulating panels 46 to the crankshaft housing is made by means of bolts in the same manner as in the case of the first embodiment. Thus, it will be appreciated that upon assemblage, there are provided generally rectangular clearances 58 between the attaching plate 50 and the thin film member 48, the number of the clearances 58 being corresponding to that of the depressions 52.

With the construction of the second embodiment, reduced engine weight and reduced production cost are expected due to use of the thin film members 48 each being considerably thinner than the sound-absorbing sheets 38 of the first embodiment. It should be noted that the construction of the attaching plates 50 prevents the thin film members 48 form producing noises. More specifically speaking, provision of the through holes 56 in the attaching plate 50 damps the pulsation of gas flow occuring in each chamber of the crankshaft housing under operation of the engine, so that pressure variation in each of the rectangular clearances 58 is decreased thereby preventing the thin film members 48 from vibrating. It has been revealed that the construction of this second embodiment exhibits excellent noise insulating effect against a low frequency noise.

Figure 7:
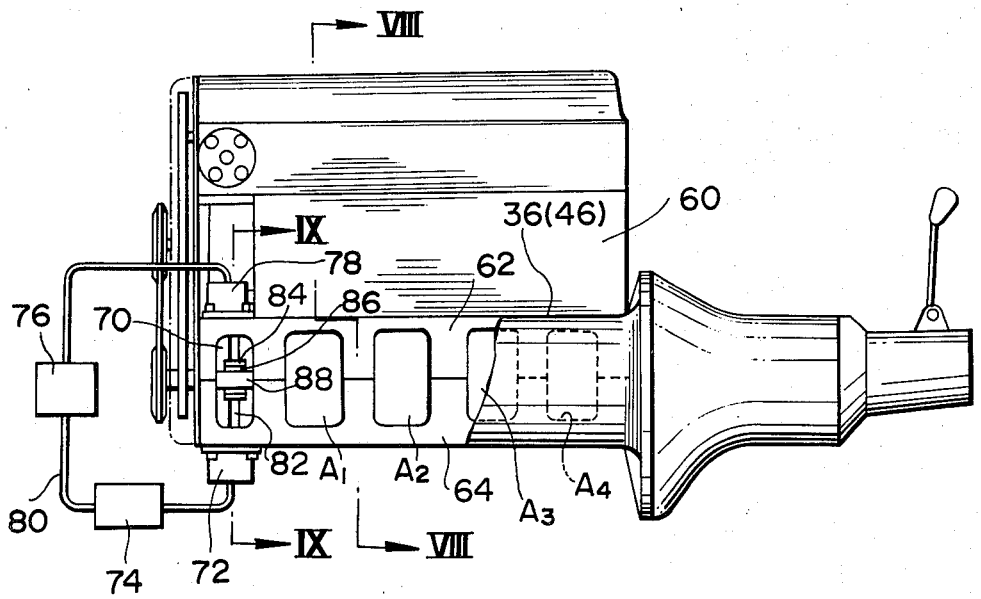
FIG. 7 is a side view of an internal combustion engine of the third embodiment according to the present invention.
Figure 8:
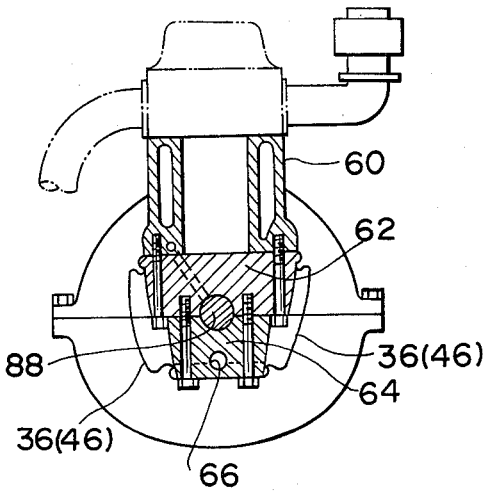
FIG. 8 is a section view taken along the line VIII—VIII of FIG. 7.
Figure 9:
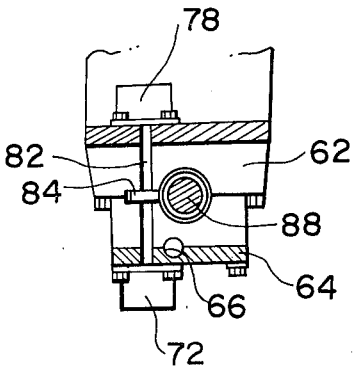
FIG. 9 is a section view taken along the line IX—IX of FIG. 7.

Referring to FIGS. 7 to 9, there is shown the third embodiment of the engine according to the present invention. In this third embodiment, a system for feeding the lubricant oil in the chambers $A_1$ to $A_4$ of the crankshaft housing to necessary portions of the engine is involved.

The internal combustion engine of this third embodiment comprises a cylinder block 60. An upper bearing supporting block 62 is bolted to the lower portion of the cylinder block 60. Similar to the afore-mentioned two embodiments, the block 62 has downwardly extending walls (no numerals) which are spaced from each other.

Each wall is formed with a round recess in which an upper half of the main bearing is tightly disposed. A lower bearing supporting block 64 having upwardly extending spaced walls is connected by means of bolts with the upper bearing supporting block 62 in substantially the same manner as in the case of the first embodiments. Each wall of the lower block 64 is formed at a portion corresponding to the recess of the corresponding wall of the upper block 62 with a round recess in which a lower half of the main bearing is tightly disposed so as to make up the entire construction of the main bearing in cooperation with the lower half of the bearing. Thus, it will be appreciated that the upper and lower blocks 62 and 64 constitute the "crankshaft housing" in which chambers $A_1$ to $A_4$ are defined. Similar to the afore-mentioned two embodiments, each wall of the lower block 64 is formed at its lower section with an opening 66 for providing communication between the chambers. As is shown by FIG. 7, the crankshaft housing is integrally formed with an extension 68 which is projected frontward of the cylinder block 60. The extension 68 has an additional chamber 70 which communicates with its neighboring chamber of the crankshaft housing through an opening formed in the wall by which these two chambers are bounded. Sound-insulating panels 36 or 46 of the type mentioned hereinabove are mounted on the crankshaft housing to sealingly close the open ends of the chambers $A_1$ to $A_4$ so that each chamber defined in the crankshaft housing proper can reserve the lublicant oil therein. If desired, a sound-insulating cover such as the upper part of the cover 20 of FIG. 1 may be provided on the engine.

The system for recirculating the lubricant oil in the necessary portions of the engine is incorporated with the additional chamber 70 defined in the extension, and comprises a first pump 72 connected to the lower side of the extension 68, an oil reservoir 74 located downstream of the first pump 72, an oil cooler 76 located downstream of the oil reservoir 74, a second oil pump 78 connected to the upper side of the extension 68, and a tube 80 connecting these parts. Upon operation of the system, the lublicant oil flows in the direction from the first pump 72 to the second pump 78 so that the oil from the second pump 78 is distributed to predetermined sections of the engine where frictional movements occur. As is best seen from FIG. 9, the first and second pumps 72 and 78 have a common driving shaft 82 on which a pinion 84 is securedly and coaxially mounted. The pinion 84 being meshingly engaged with a screw gear 86 mounted on the crankshaft 88, so that the rotational movement of the crankshaft 88 drives the pumps 72 and 78.

The foregoing description of the preferred embodiments of the invention have been presented for purposes of illustration and description. They are not intended to be exhaustive or to limit the invention to the precise forms disclosed, and obviously many modifications and variations are possible in light of the above teachings. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A reciprocating piston internal combustion engine comprising:

a cylinder block having engine cylinders formed therein;

a crankshaft housing mounting on said cylinder block for positioning a crankshaft therein, said housing including an upper section with downwardly extending partition walls and a lower section with upwardly extending partition walls integrally connected to a common bottom wall, said sections being coupled whereby said downwardly extending partition walls are mated with corresponding upwardly extending partition walls thereby forming open chambers separated by said mated downwardly and upwardly extending walls, each of said mated walls being formed for supporting a journal of said crankshaft; and a sound-insulating panel attached to said crankshaft housing in a manner to sealingly enclose openings of all of said open chambers thereby permitting said chambers to serve as lubricant reservoirs.

2. A reciprocating piston internal combustion engine as claimed in claim 1, in which said crankshaft housing sections are bolted to each other to define therebetween said open chambers.

3. A reciprocating piston internal combustion engine as claimed in claim 2, wherein said downwardly extending partition walls each has a rounded recess in which an upper half of a main bearing is tightly disposed, and wherein said upwardly extending partition walls each has a rounded recess in which a lower half of a main bearing is tightly disposed, said upper and lower walls being couled to each other in such a manner that the lower edges of the downwardly extending walls are in contact with the upper edges of said corresponding upwardly extending walls.

4. A reciprocating piston internal combustion engine as claimed in claim 3, in which said upper section is integral with said cylinder block.

5. A reciprocating piston internal combustion engine as claimed in claim 3, in which said upper section is a separate member bolted to said cylinder block.

6. A reciprocating piston internal combustion engine as claimed in claim 1, in which a peripheral portion of said crankshaft housing which bounds the openings of said open chambers is convexly curved.

7. A reciprocating piston internal combustion engine as claimed in claim 1, in which said sound-insulating panel comprises a sheet made of a high damping material.

8. A reciprocating piston internal combustion engine as claimed in claim 7, in which said sound-insulating panel further comprises a frame to which said sheet is secured by baking, and a gasket.

9. A reciprocating piston internal combustion engine as claimed in claim 7, in which said sound-insulating panel further comprises an attaching plate having depressions with forms which match forms of the open ends of said open chambers, and a gasket, said depressions having at their bottom walls a plurality of openings, the connection of said sound-insulating panel to said housing device being arranged so that projected backwalls of said attaching plate defined by said depressions are received in the openings of said open chambers with considerable clearances between the bottom walls of said depressions and said sheet.

10. A reciprocating piston internal combustion engine as claimed in claim 1, further comprising lubricant recirculating means by which the lubricant in said chambers in said crankshaft housing is fed to known portions of said engine where frictional movements occur upon operation of the engine.

11. A reciprocating piston internal combustion engine as claimed in claim 10, in which said recirculating means comprises an additional chamber formed in an extension of said crankshaft housing, said additional chamber communicating with the previously mentioned open chambers through openings formed in said partition walls, conduit means for providing communication between said additional chamber and said known portions, and pumping means for moving the lubricant from said additional chamber to said known portions through said conduit means.

12. A reciprocating piston internal combustion engine as claimed in claim 11, in which said lubricant recirculating means further comprises a reservoir and a cooler which are disposed along said conduit means.

13. A reciprocating piston internal combustion engine as claimed in claim 11, in which said pumping means comprises first and second pumps which are driven by said crankshaft.

* * * * *